United States Patent [19]

Reavis, Jr. et al.

[11] 4,017,140

[45] Apr. 12, 1977

[54] WIRE-IN-SLOT ELECTRICAL CONNECTIONS

[75] Inventors: Robert Philmore Reavis, Jr., Statesville; Melvin Andrew Soderstrom, Advance, both of N.C.

[73] Assignee: AMP Incorporated, Harrisburg, Pa.

[22] Filed: Oct. 28, 1975

[21] Appl. No.: 625,810

[52] U.S. Cl. ..... 339/98; 339/101

[51] Int. Cl.[2] ..... H01R 9/08

[58] Field of Search ..... 339/96, 97 R, 97 P, 339/98, 99 R, 101

[56] References Cited

UNITED STATES PATENTS

| | | | |
|---|---|---|---|
| 2,932,685 | 4/1960 | Raila et al. | 339/96 UX |
| 3,142,524 | 7/1964 | McDonough | 339/98 |
| 3,571,779 | 3/1971 | Collier | 339/96 X |
| 3,596,231 | 7/1971 | Melton | 339/96 |
| 3,793,612 | 2/1974 | Driscoll | 339/98 |
| 3,854,114 | 12/1974 | Kloth et al. | 339/97 R |
| 3,858,157 | 12/1974 | Bazille, Jr. | 339/97 R X |

*Primary Examiner*—Roy Lake
*Assistant Examiner*—Howard N. Goldberg
*Attorney, Agent, or Firm*—Frederick W. Raring; Robert W. Pitts; Jay L. Seitchik

[57] ABSTRACT

Wire-in-slot connecting device comprises a plate-like connector member having an arcuate cross-section and having wire-receiving slot extending inwardly from one end thereof. An insulating housing for the connector member has wire-receiving openings extending therein from one side thereof and has connector member openings extending inwardly from an adjacent side which intersect the wire-receiving openings. The connector member openings have a cross-section which is in the form of a geometric segment, the radius of the arcuate wall thereof conforming to the radius of the connector member.

7 Claims, 8 Drawing Figures

WIRE-IN-SLOT ELECTRICAL CONNECTIONS

BACKGROUND OF THE INVENTION

This invention relates to wire-in-slot connecting devices of the general type disclosed in U.S. Pat. Nos. 3,854,114 and 3,012,219 and in United Kingdom Pat. No. 615,737 which has an accepted date of Jan. 11, 1949.

Wire-in-slot connecting devices of the general type disclosed in the above-identified publications have been widely accepted in the electrical industry for connecting wires to each other, for connecting individual wires to electrical terminals, and for other uses. Connecting devices of this type are extremely convenient to use for the reason, among others, that it is not necessary to strip the insulation from the wire prior to moving the wire into the slot in the connecting device; the insulation is simply displaced as the wire moves into the slot so that the edges of the slot establish electrical contact with the conducting core of the wire.

A comparative shortcoming of some known connecting devices of the wire-in-slot type is that they are not entirely satisfactory for use with stranded wire and they have been used in the past primarily with solid wire. The difficulties with stranded wire probably stem from the fact that when a stranded wire is forced into a wire receiving slot, the strands tend to separate or splay and distribute themselves along the length of the slot so that they are in side-by-side relationship; they do not remain as a compact mass having a circular or oval shaped cross-section. As a result of this splaying or distribution of the strands, the edges of the slot do not maintain adequate contact pressure against the strands of the wire. Where the wire has only a single strand, the slot can be dimensioned such that its edges do maintain intimate contact with the wire.

In accordance with one aspect of the invention, a wire-in-slot connecting device is provided which is particularly intended for stranded wires. The connecting device comprises a housing and a metallic connector member which has a configuration and other structural features which overcome the problems and difficulties previously encountered with stranded wire connections. Specifically the housing for the metallic connecting device is provided with a means for holding the portion of the wire which is immediately adjacent to the metallic connector member in a compact mass so that the strands which are between the edges of the slot are restrained from moving apart and distributing themselves along the length of the slot with a resulting loss in contact pressure.

In accordance with a further aspect of the invention, there is provided an improved terminal block or junction block for the general type used to make common electrical connections among two or more wires. Junction blocks of this type and having this capability are widely used in a variety of circumstances such as in machines or appliances where the various components of an electrical system including switches, motors, relays etc. must be interconnected.

It is accordingly an object of the invention to provide an improved wire-in-slot type connecting means. A further object is to provide a wire-in-slot connecting means for stranded wires as well as solid wires. A further object is to provide an improved terminal block or junction block which can in a minimum of time be applied to a plurality of wires to form selective interconnections among the wires.

These and other objects of the invention are achieved in preferred embodiments thereof which are briefly described in the foregoing abstract, which are described in detail below, and which are shown in the accompanying drawing in which.

Figure 2:
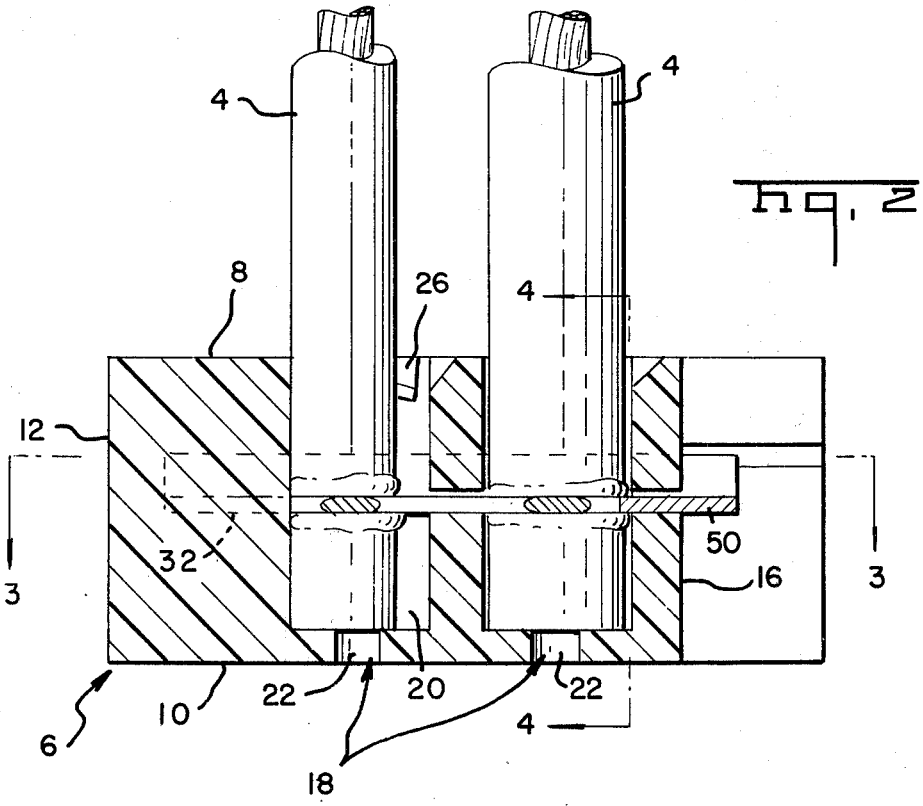
FIG. 2 is a cross-sectional view taken along the lines 2—2 of FIG. 1, this view showing the manner in which two wires are electrically connected by a single metallic connecting member.
Figure 4:
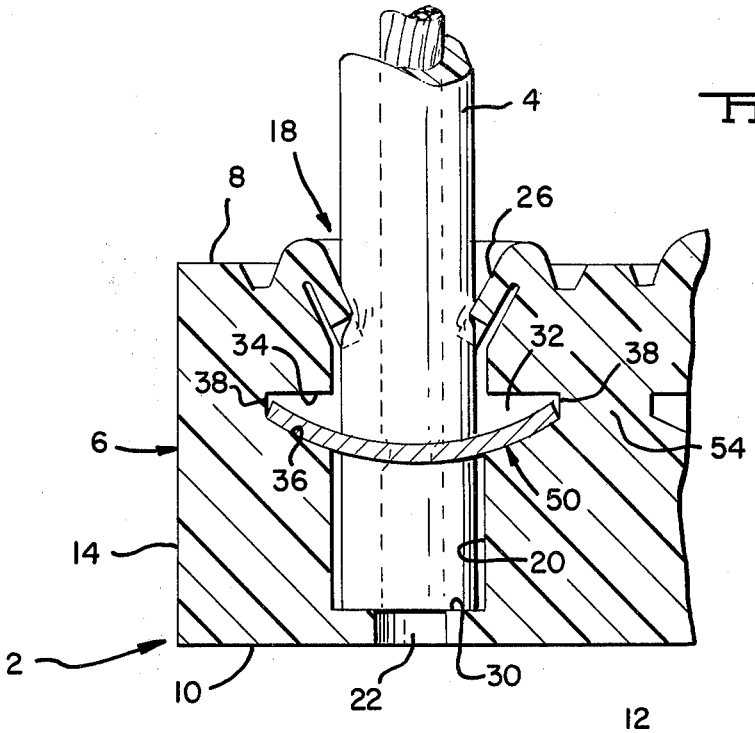

FIGS. 3 and 4 are views taken along the lines 3—3 and 4—4 of FIG. 2.

Figure 5:
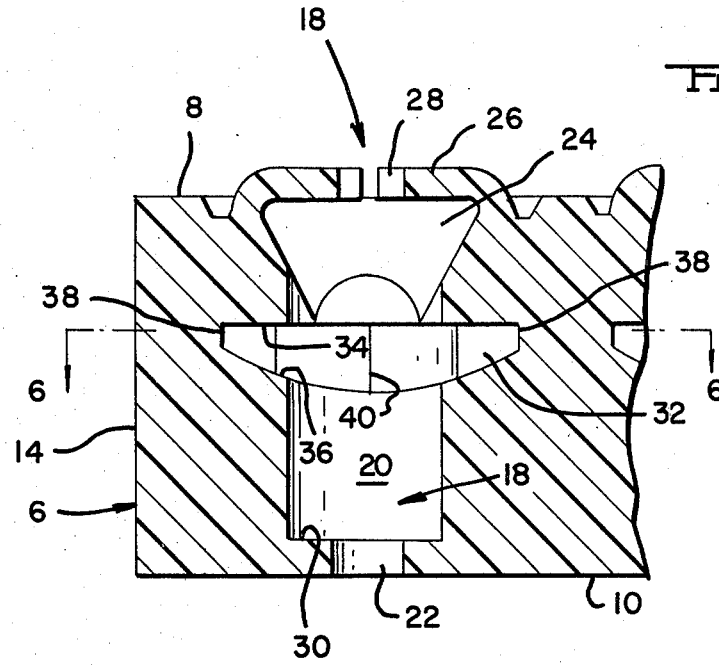

FIG. 5 is a view similar to FIG. 4 but showing only the housing without a terminal or a wire therein.

Figure 6:
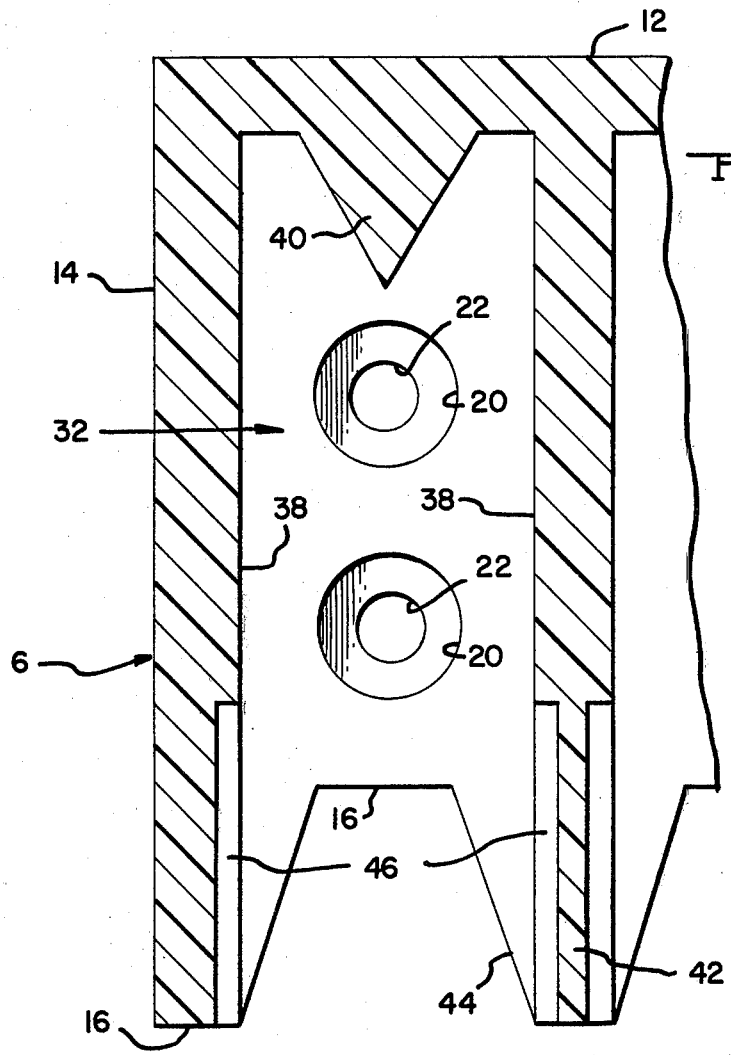

FIG. 6 is a view taken along the lines 6—6 of FIG. 5.

Figure 7:
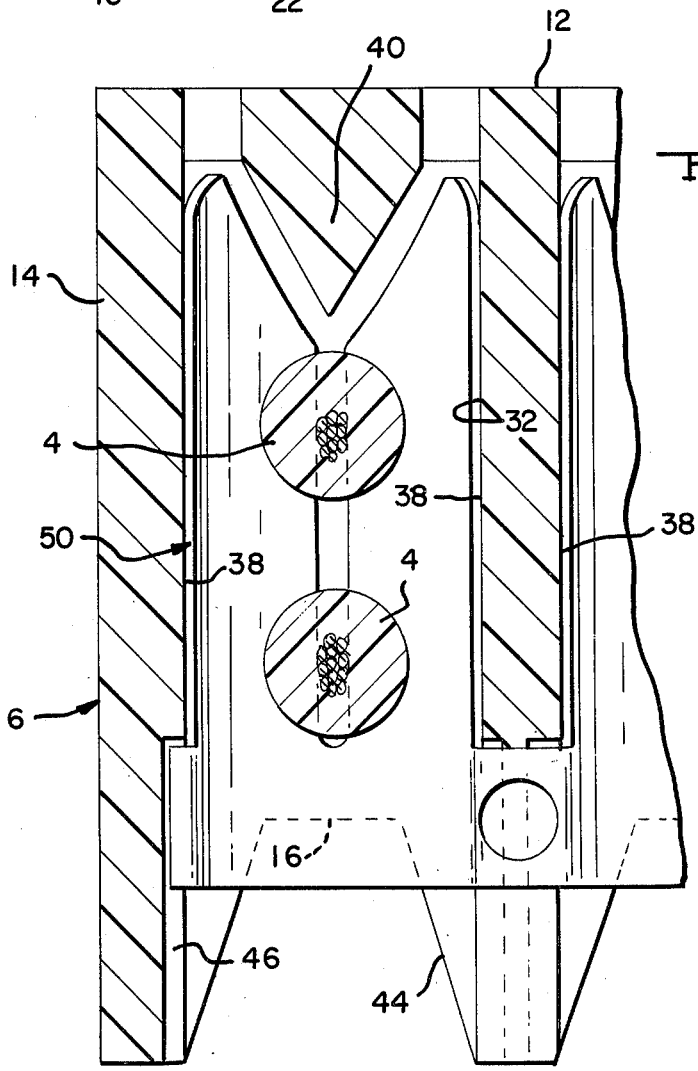

FIG. 7 is a plan view of a die progression illustrating the manufacture of metallic connecting devices in accordance with the invention.

Figures 7, 8:
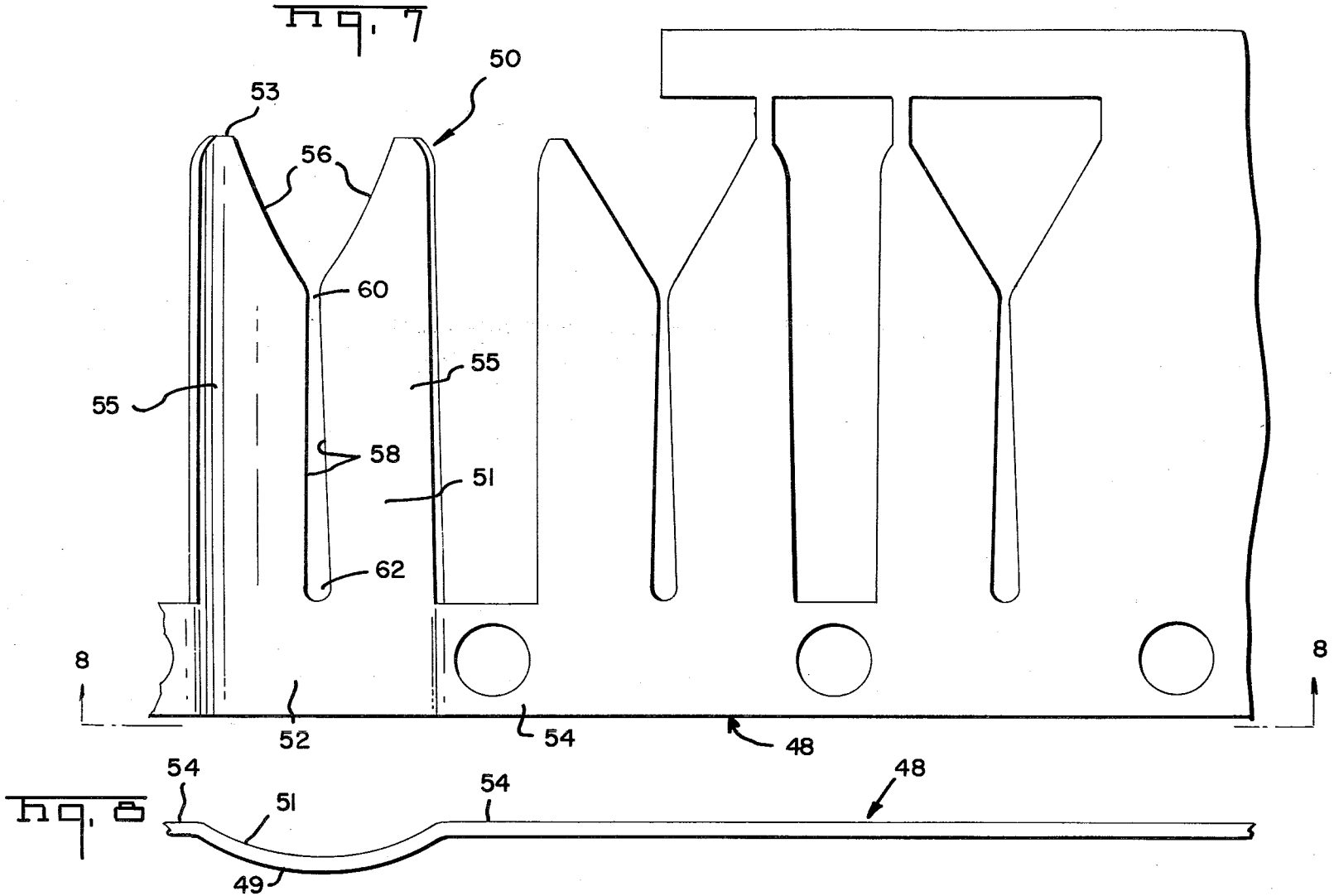

FIG. 8 is a view taken along the lines 8—8 of FIG. 7.

Figure 1:
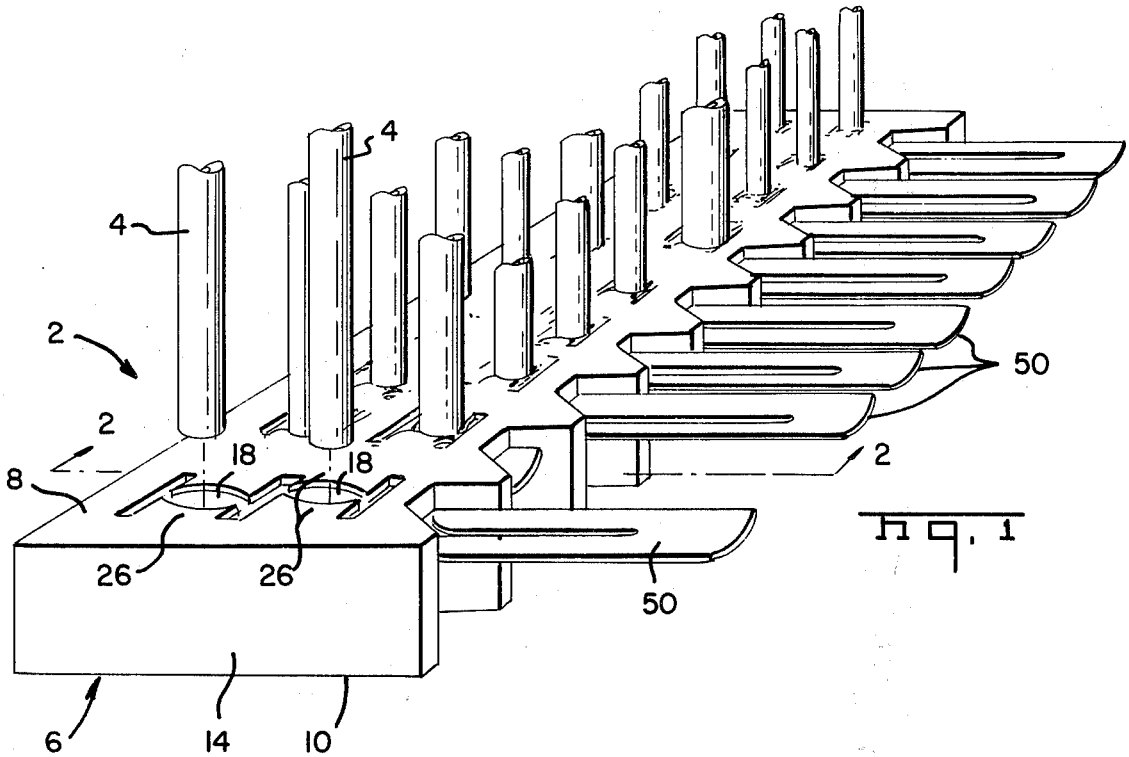
FIG. 1 is a perspective view of a preferred form of junction block in accordance with the invention, this view showing the positions of the connector members prior to their being fully inserted into the housing member.

Referring first to FIG. 1, a terminal block 2 in accordance with the invention is adapted to make common electrical connections among two or more wires 4 at a common location. As previously mentioned, connector assemblies or terminal blocks of this type are widely used to form the required connections among the electrical components of appliances or the like. The connector assembly comprises an insulating housing 6 having oppositely directed faces 8, 10 a backwall 12, end walls 14, and a front wall 16. A plurality of associated pairs of wire-receiving cavities 18 extend through the housing from the face 8 to the face 10, the two openings of each assorted pair being in side-by-side parallel relationship and between the front and back walls 12, 16.

As shown in FIG. 5, each wire-receiving cavity has an intermediate enlarged diameter portion 20, the diameter of which is at least slightly greater than the diameter of the largest wire for which the device is intended. A relatively small opening extends from the portion 20 of the wire receiving opening as shown at 22 and opens onto the face 10. Each wire-receiving opening 18 further has a conical lead-in portion 24 which extends inwardly from the face 8 and merges with the intermediate portion 20, this lead-in portion serving to guide a wire into the intermediate portion until the end of the wire is against the shoulder 30 defined by the smaller diameter portion 22 of the opening. The end of each wire receiving opening 18 is partially covered at the face 8 of housing 2 by a thin integral membrane 26 which extends radially inwardly with respect to the opening from the margins of the conical section 24 and which surrounds a small oval shaped centrally located opening 28. The membrane is formed in two symmetrical parts to permit inward deformation thereof as described below. The opening 28 is axially aligned with the conical section 24 and the intermediate section 20 of the opening 18. The width of the opening 28 is substantially less than the diameter of the smallest wire for which the device is intended for reasons which will become apparent from the description which follows.

The housing is advantageously manufactured of a suitable thermo-plastic by an injection molding process, suitable materials being for example, polypropylene, glass filled nylon or a similar material. In any event, the material should be relatively firm in thick sections but it should be compounded and plasticized such that it is flexible and elastically deformable in thin sections. This flexibility is required in order to permit the membrane 26 to serve as a wire-clamping means.

Each aligned pair of wire-receiving openings 18 has associated therewith a cavity or opening 32 for an individual metallic connector member 50 of the general type shown in FIGS. 7 and 8. The openings 32 extend inwardly from the front wall 16 of the housing 2 and intersect the wire-receiving openings 18 as shown best in FIG. 5. The openings 32 have a cross section in the form of a geometric segment and thus have a flat wall 34 which is proximate to the face 8 and an arcuate wall 36 which is opposed to the flat wall. The walls 36, 34 do not intersect to form a true geometric segment but rather extend to narrow sidewalls 38. For reasons explained below, these sidewalls advantageously should have a width which is substantially equal to the thickness of the connector member 50.

Referring to FIG. 6, the faces 8, 10 are cut away as shown at 44 at the entrance to each of the openings 32 and additionally, opposed shallow grooves 46 are provided on the opposed endwalls 38, these grooves extending inwardly for a distance which is slightly greater than the depth of the openings 44. It will be apparent from FIG. 6 that the remaining barrier walls 42 between adjacent openings 32 are relatively thin at the front wall of the housing and this thin portion 42 of each barrier wall can be penetrated by portions of a strip of connectors as will be explained below. It should also be noted in FIG. 6 that a triangular projection 40 extends from the inner end of each opening 32 towards the front of the opening. This projection serves to center the metallic connector member 50 and also serves to strengthen the wall 12 of the housing. Small openings may be provided in the face 12 on each side of the projection 40 for core pins in accordance with conventional plastic molding practice.

The wires 4 are electrically connected to each other by individual metallic connecting device 50, FIGS. 7 and 8, each of which has an arcuate cross-section with a convex surface 49 and a concave surface 51. Each connecting device has a wire receiving slot which extends inwardly from its wire receiving end 53 towards its other end 52. The wire-receiving slot has an entrance portion having convergent edges 56 which extend to a normally narrow portion 60. The opposed edges 58 diverge from each other from the narrow portion 60 so that the inner end 62 of the slot is relatively wide.

These connecting devices are manufactured as a continuous strip 48 with the individual connecting devices integral with each other by means of connecting slugs 54. The slugs have pilot holes which are formed during the stamping and forming process.

As shown in FIGS. 7 and 8, the strip is manufactured by first blanking from a continuous strip of sheet metal the individual connector members and then forming the connector members into their arcuate shape. The connecting slugs remain flat as shown best in FIG. 8 and the strip is normally supplied to the user as a continuous strip so that a plurality of integral connector members can be inserted into the housing to form a common electrical connection among a plurality of wires as will be described below.

In use, and where it is desired to connect two wires to each other, the wires are inserted into an associated pair of wire-receivings openings 18 through the membranes 26 until the ends of the wires are disposed against the shoulders 30. When the wires are thus inserted, the membranes 26 will be resiliently deformed inwardly so that they extend inwardly of the openings 18 as shown in FIG. 4. After insertion of the wires, the deformed and compressed membranes 26 will form constrictive elastic collars in surrounding relationship to the wires 4. After insertion, the wires are supported by the surfaces of the enlarged portions of the openings 20 of the openings 18. An individual connecting device 50 is then cut from the strip 48 and inserted into the opening 32 until its end 53 is adjacent to the inner end of the opening. During movement of the connector member into the opening, the convergent edges 56 move over the surface of the first wire and the arms 55 of the connecting device are flexed apart so that the gap at 60 is widened. The edges 58 penetrate the insulation of the wire so that electrical contact is established with the core of the wire. Upon further movement of the connector member into the opening 32, the second wire which is adjacent to the back wall 12 is encountered so that after full insertion of the connecting device into the opening, the arms 55 are in straddling relationship to both the wires. After such full insertion, the edges 58 will extend substantially parallel to each other and will be in electrical engagement with both of the wires.

As previously noted, the sidewalls 38 have a width which is substantially equal to an individual connector member 50. By virtue of this relationship, the side edges of the connector member are restrained against movement after insertion and when an axial pull is applied to either of the wires, the connector member is prevented from reorienting itself. Therefore, even though the curvature of the connector members may be decreased as a result of the axial pull on the wire, the edges 58 will always be on diametrically opposite sides of the wires and will not be offset along the axis of the wire so that the electrical contact will be maintained.

If it is desired to make a common connection among three or more wires, the wires are inserted into wire-receiving openings in immediately adjacent pairs of these openings 18 as described above and two or more connector members 50, connected by a slug 54, are severed from the strip 48. The two or more connector members are then moved into the adjacent openings 32 and electrical connections are formed with the wires, the connecting slug 54 acting to common the three or more connections. When two or more connector members 50 are moved into adjacent openings 32, the connecting slug is moved into the thin barrier wall section 42 and it cuts or compresses this thin wall at that time. The channels 46 which are in alignment with the end walls 38 are provided to receive any rough edges which may remain after the individual connecting devices are cut from the strip.

While connecting assemblies in accordance with the invention can be made in any desired size and can be designed for a range of wire gauges, careful attention must be given to the dimensions for a particular wire gauge. For example, where the wires are AWG 18 gauge 41 strands, the connecting device can be manufactured from No. 4 hard brass having a thickness of 0.016 inch and having a slot formed therein which is about 0.015 inch wide at its inner end 62 and 0.010 inch wide at its constricted portion 60. The overall dimensions of a connector for this wire may be about 0.26 inch by 0.60 inch. The opening 32 advantageously has a curvature 36 which conforms to the radius of the convex side 49 of the connecting device, and the width of the opening is advantageously such that the edges of the connecting device are substantially against the end-walls 38 as shown in FIG. 4. Good results will be obtained if the concave side 51 of the connecting device has a radius of about 0.200 inches.

The membrane member 26 is highly advantageous in that after insertion of the wires, these deformed membranes will retain the wires and the wire-receiving openings prior to movement of the connector members into the connector receiving openings. This feature is desirable in a production line wiring process in that the individual wires can be inserted into the junction block 2 at appropriate times and the appropriate stations on the production line and after all of the wires have been inserted, the connector members can all be inserted at one station of the assembly line. The connector members may be inserted either manually or by a suitable semi automatic machine which can be programmed to insert an individual connector member where two wires are to be connected to each other or two or more connector members into those parts of the junction block at which three or more wires must be commonly connected.

The strands of the wires 4 are retained as a relatively compact mass as shown in FIG. 3 by virtue of the fact that the portions of the wire which are immediately adjacent to the connector member 50 are supported by the surface of the enlarged portion 20 of the wire receiving slot. By virtue of this support of the wires, the strands of the wires are prevented from splaying or distributing themselves along the length of the slot and good electrical contact between the wires and the connector members is maintained.

It will also be apparent that the collar effect obtained from the compressed membrane 26 functions as a strain relief which opposes and protects the electrical connection against an axial pull on the wire. Furthermore, the arcuate configuration of the connector member 50 with the concave surface 51 facing the membrane establishes a condition which counteracts the effects of an axial pull on the wire. It will be apparent from FIG. 4 that if the wire is pulled away from the housing, the effect will be to tend to flatten or increase the radius of the connector member. This increase in the radius will tend to reduce the width of the slot in the connector member so that the edges 58 will move towards each other and tighten their grip on the wire.

Connector members of the type shown at 50 are extremely efficient in the sense that they develop a high contact pressure on inserted wires relative to the amount of material (brass or other stock metal) required for their manufacture. The improved efficiency is achieved by virtue of the fact that when the wires are inserted into the connector member, the connector member is stressed in two different modes, both of which may contribute to the development of the contact pressure. In accordance with one stress mode, the two arms 55 of the connector member are flexed apart by the wires and they have a tendency to return to their normal positions. The stresses in the connector member which give rise to this tendency contribute to the contact pressure developed between the conducting cores of the wires and the edges 58 of the wire receiving slot. The second mode of stress results from the arcuate configuration of the connector member. As noted above, an axial pull on the wire tends to flatten the connector member so that the contact pressure at the electrical interface is increased. The effectiveness of the second stress mode comes into play when an axial pull is applied to the wire and the added contact pressure tends to counteract the deletarious effect of the axial pull on the wire.

Changes in construction will occur to those skilled in the art and various apparently different modifications and embodiments may be made without departing from the scope of the invention. The matter set forth in the foregoing description and accompanying drawings is offered by way of illustration only.

What is claimed is:

1. Connecting means for forming an electrical and mechanical connection with a wire comprising:

an insulating housing, a wire receiving cavity extending into said housing from one side thereof, a connecting device cavity extending into said housing from a side which is adjacent to said one side, said connecting device cavity having a flat surface and an arcuate surface, said arcuate surface being opposed to said flat surface so that said connecting device cavity has a substantially geometrically segmental cross section, said flat surface being proximate to said one side of said housing and said arcuate surface being remote from said one side, said cavities intersecting each other, an electrical connecting device comprising a plate-like member having a wire receiving end, said connecting device having an arcuate cross section and having a wire-receiving slot extending inwardly from said wire-receiving end towards its other end, the curvature of the cross-section of said connecting device conforming to the curvature of said arcuate surface of said connecting device cavity whereby, upon inserting said wire into said wire-receiving cavity and inserting said connecting device into said connecting device cavity, wire receiving end first, said wire will move relatively into said slot.

2. Connecting means as set forth in claim 1, said connecting device cavity having opposed surfaces which extend between said flat surface and said arcuate surface, whereby said connecting device cavity has a cross section in the form of a geometric segment having truncated sides, said connecting device having a thickness which is substantially equal to the width of one of said opposed surfaces whereby, after insertion of said connecting device into said connecting device cavity, the side edges of said connecting device are restrained against movement.

3. Connecting means as set forth in claim 1, said housing being of a polymeric material which is firm in thick sections and flexible in thin sections, said housing having on said one side thereof integral membrane means extending inwardly over said wire receiving cavity said membrane means being deformable inwardly of said wire receiving cavity upon insertion of said wire whereby after insertion of said wire, said membrane means forms a constrictive collar in gripping relationship to said wire.

4. Connecting means for electrically connecting two insulated wires to each other, said connecting means comprising:

an insulating housing, a pair of wire-receiving cavities extending into said housing from one side thereof, said wire-receiving cavities being in side-by-side parallel relationship, a connecting device cavity extending into said housing from a side which is adjacent to said one side, said connecting device cavity having a flat surface and an arcuate surface, said arcuate surface being opposed to said flat surface so that said connecting sevice cavity has a substantially geometrically segmental cross section, said flat surface being proximate to said one side of said housing and said arcuate surface being remote from said one side, said connecting device cavity intersecting each of said pair of wire receiving cavities, an electrical connecting device comprising a plate-like member having a wire receiving end, said connecting device having an arcuate cross section and having a wire-receiving slot extending inwardly from said wire-receiving end towards its other end, the curvature of the cross-section of said connecting device conforming to the curvature of said arcuate surface of said connecting device cavity whereby, upon inserting said wires into said wire-receiving cavities and inserting said connecting device into said connecting device cavity, wire receiving end first, said wires will move relatively into said slot and the edges of said slot will penetrate the insulation of said wires and contact the conducting cores of said wires whereby said wires will be electrically connected to each other.

5. Connecting means as set forth in claim 4, said connecting device cavity having opposed surfaces which extend between said flat surface and said arcuate surface, whereby said connecting device cavity has a cross section in the form of a geometric segment having truncated sides, said connecting device having a thickness which is substantially equal to the width of one of said opposed surfaces whereby, after insertion of said connecting device into said connecting device cavity, the side edges of said connecting device are restrained against movement.

6. Connecting means as set forth in claim 5, said housing being of a polymeric material which is firm in thick sections and flexible in thin sections, said housing having on said one side thereof integral membrane means extending inwardly over each of said wire receiving cavities, each of said membrane means being deformable inwardly of its respective wire receiving cavity upon insertion of said wires whereby, upon insertion of said wires, said membrane means is deformed inwardly of said wire-receiving cavities and forms constrictive collars in gripping relationship to said wires.

7. Connecting means as set forth in claim 5, said housing being elongated and having a plurality of pairs of said wire receiving cavities extending therein from said one side and having a plurality of spaced-apart connecting device cavities extending therein from said adjacent side, each of said connecting device cavities intersecting one of said pairs of wire-receiving cavities, said connecting device being integral with connecting sections at said other end, said connecting sections being integral with additional connecting devices which are identical to said connecting device whereby a plurality of wires, in excess of two, can be commonly connected by inserting said wires into adjacent pairs of wire-receiving openings, and inserting a plurality of connecting devices which are integral with connecting sections into the associated connecting device cavities.

* * * * *